US005280678A

United States Patent [19]

Jennings

[11] Patent Number: 5,280,678

[45] Date of Patent: Jan. 25, 1994

[54] METHOD AND APPARATUS FOR MONITORING THE PROCESSING OF A MATERIAL

[76] Inventor: Thomas A. Jennings, 303 Llandrillo Rd., Bala Cynwyd, Pa. 19004

[21] Appl. No.: 988,227

[22] Filed: Dec. 9, 1992

Related U.S. Application Data

[62] Division of Ser. No. 610,242, Nov. 6, 1990.

[51] Int. Cl.[5] ..... F26B 3/00

[52] U.S. Cl. ..... 34/30; 374/29

[58] Field of Search ..... 374/29, 30, 33, 129; 34/1 A, 1 E, 1 K, 89, 1 R, 1 P, 1 W, 1 Y, 30, 54

[56] References Cited

FOREIGN PATENT DOCUMENTS 1068740 1/1984 U.S.S.R. ..... 374/29

1515072 10/1989 U.S.S.R. ..... 374/29

*Primary Examiner*—Henry A. Bennet

*Attorney, Agent, or Firm*—William H. Murray

[57] ABSTRACT

A method and apparatus are provided for determining a process parameter of a material in a processing system having two containers. The material being monitored is disposed in one container and a single thermal energy control device is applied to both containers. The heat flux of each container is determined while the single thermal control device is applied to both containers. The process parameter is determined in accordance with the determined heat flux. The thermal energy control device may be a single heating surface for warming the two containers, or a cooling device such as a refrigerator. The process parameter may be the drying rate of the material and the drying rate can be determined during the processing of the material. The drying rate and the percent of drying can be displayed and the thermal energy level of the containers can be controlled according to the determined drying rate. A calibration procedure for calibrating the apparatus is also provided.

23 Claims, 1 Drawing Sheet

METHOD AND APPARATUS FOR MONITORING THE PROCESSING OF A MATERIAL

This application is a division of U.S. Ser. No. 07/610,242 filed Nov. 6, 1990.

BACKGROUND OF INVENTION

1. Field Of The Invention

This invention relates to measuring process parameters, and in particular, to measuring process parameters related to heat flux.

2. Background Art

Drying is often used to achieve stability of a material. The drying process may be as simple as the direct evaporation of water from a system or it may be a more complex process such as the lyophilization process. The lyophilization process involves freezing of the material, sublimation of the ice crystals, and desorption of the remaining water vapor.

Regardless of the type of drying process, there is a need to know when the material has been sufficiently dried. If insufficient water is removed from the system, there may be a loss in product or its stability. Likewise, the material may be damaged if the product is over-dried. Furthermore, many other parameters related to various methods of processing materials must be reliably measured in order for a material to be processed properly.

A number of methods are known in the prior art for monitoring various parameters involved in the drying process and other types of processes. The simplest method of monitoring a process is to measure the temperature of the material being processed. A change in temperature indicates the completion of a particular phase of the process. Other techniques are known for monitoring both the composition of the gas released during a process such as a drying process and the shelf temperature during the process. The change in the partial pressure of water vapor is also used as an indication of the completion of a drying process. Still other known prior art methods for monitoring the processing of materials such as the drying of the material involve measurement of an electrical property of the material. For example, the resistance of the material may be measured.

The use of these methods, either separately or in combination, provides at best a qualitative assessment of the process. They do not take into account variations such as changes in the quantity of solvent present in the material during the processing. For example, the quantity of water in a material varies as it is dried.

It is also known to use differential scanning calorimetry as an analytical tool. In this method, two containers are placed on separate heating surfaces to measure the heat into a sample container and the heat into a reference container when the two containers are placed on the separate heating surfaces of the calorimeter. These differential scanning calorimetry systems are complex because of the problems raised by the use of the two separate heating surfaces. Further complicating the use of these calorimetry systems is the practical consideration that no two containers are exactly alike in their thermal properties. Thus, the two separate heating surfaces for heating the reference container and the sample container of the differential scanning calorimetry system must be run at different temperatures to compensate for the different thermal properties of the containers. This problem made calibrating differential scanning calorimetry systems very complex.

A further drawback in the use of known differential scanning calorimetry techniques is that it is not possible to determine the drying rate of a material during the monitored process. Differential scanning calorimetry can be used to determine parameters of a material prior to processing of the material. Additionally, further determinations of the parameters of materials can be made after processing of the material is complete. However, the drying rate can not be determined from this data.

SUMMARY OF THE INVENTION

The present invention provides a method and apparatus for quantitatively determining process parameters of a material being processed during a process such as a drying process. The drying of this process may constitute the removal of water from a material, but is not limited to water. It is understood that this invention is also applicable to materials containing hydrocarbon solvent systems. The apparatus and method of the present invention determine the process parameters related to the material being processed, during the processing of the material. These determinations are made according to the difference between the heat flux to the material in a sample container and the heat flux to an empty reference container. Furthermore, these determinations are made while a single thermal energy control device is applied both to the reference container and to the sample container.

Using this method, the parameter being measured may, for example, be the rate of drying in a drying process. As a result of such a drying process, the heat flux to the sample container containing the undried material is greater than that of the empty reference container. The difference in heat flux between the sample and reference containers when drying occurs and when it does not occur is used to determine a measure of the rate of drying of the material.

The method of the present invention for determining the parameters of a material being processed is independent of the type of sensors used to control the process. Determinations of the rate of drying of the material during the process permit control of the various other process parameters. For example, the pressure in the drying chamber and the thermal energy applied to the two containers, as well as the rate of drying itself, may be controlled based upon the rate of drying while the drying process is still underway. A method of calibrating the apparatus of the present invention is also provided.

BRIEF DESCRIPTION OF THE DRAWING

The drawing shows the heat flux detection system of the present invention including a sample container and a reference container on a single heating surface and a computer display system.

DESCRIPTION OF THE PREFERRED EMBODIMENT

Figure 1:
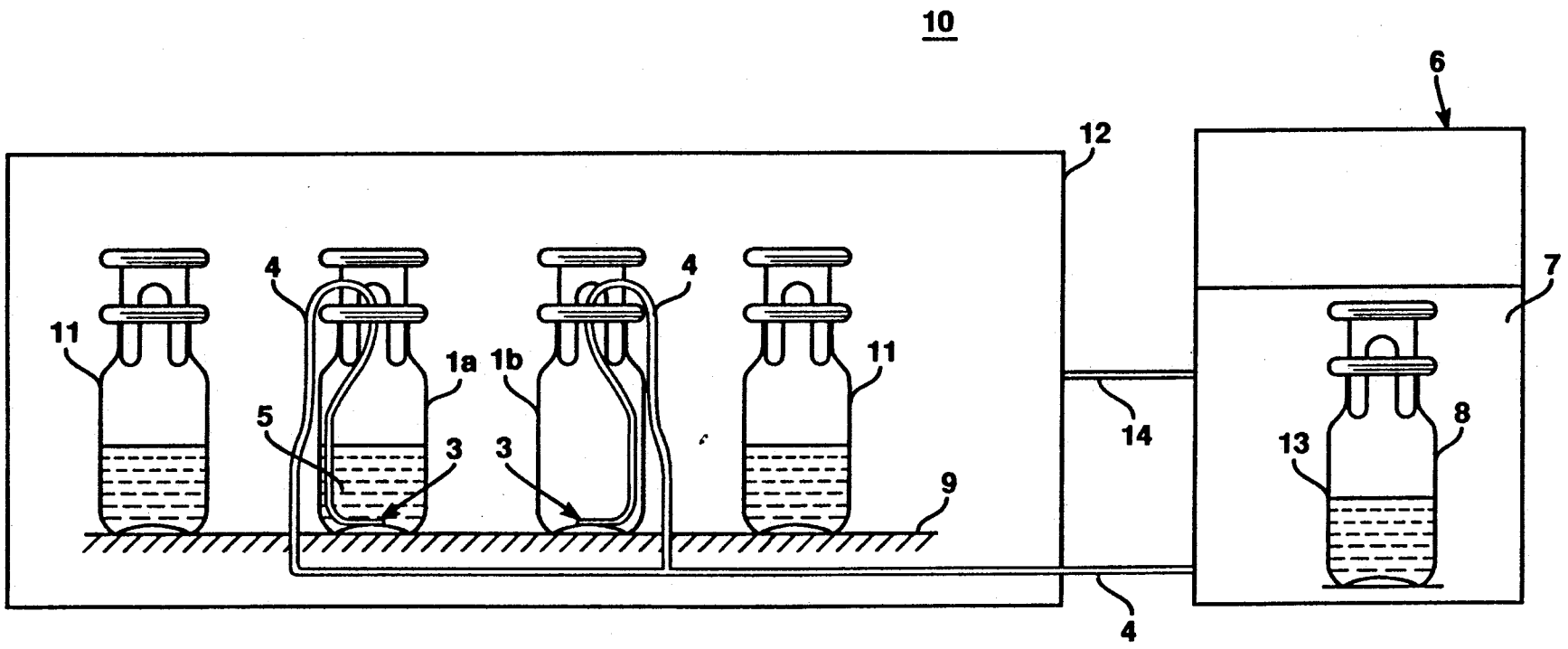

Referring now to the drawing, there is shown a schematic diagram of heat flux detection system 10 of the present invention as well as computer system 6 for performing the processing functions of the method of the present invention. Heat flux detection system 10 includes heat flux detection containers 1*a,b* disposed on single heating surface 9 or single heating shelf 9. Each heat flux detection container 1*a,b* is formed with substantially the same composition, dimensions, and mass as the other heat flux detection container 1a,b. Therefore heat flux detection containers 1a,b have substantially similar thermal properties. Additionally, heat flux detection containers 1a,b are formed with the same composition, dimensions, and mass as the other containers 11 for use in the apparatus of the present invention during the processing of material 5. Further containers 11 contain material 5 being processed when the processing operation of heat flux detection system 10 is performed.

Heat flux detection containers 1a,b are each provided with, for example, thin thermocouple sensor 2, which is disposed upon heat flux detection containers 1a,b. Thermocouple sensors 2 may be approximately five one-thousandths of an inch thick and are disposed upon heat flux detection containers 1a,b. For example, the thermocouple sensors 2 may be cemented to the base of heat flux detection containers 1a,b. Junctions 3 of thermocouple sensors 2 are disposed approximately in the middle of the base of heat flux detection containers 1a,b. Sensor output leads 4 of thermocouple sensors 2 pass through the tops of heat flux detection containers 1a,b and are attached to the sides of containers 1a,b. A known mass of material 5 to be dried is placed within sample heat flux detection container 1a for monitoring of a process by heat flux detection system 10.

Heat flux detection containers 1a,b are placed on a single heating shelf 9 in drying chamber 12 within heat flux detection system 10. Further containers 11 containing material 5 to be processed are also placed on single heating shelf 9 within heating chamber 12 during processing with heat flux detection system 10. Further containers 11 have approximately the same mass of material 5 as heat flux detection container 1a or sample container 1a. It will be understood by those skilled in the art that further containers 11 are formed of substantially the same composition, dimensions, and mass as heat flux detection containers 1a,b, and have substantially similar thermal properties as containers 1a,b. This causes the monitored heat flux of heat flux detection containers 1a,b to be representative of the heat flux of further containers 11 having material 5 being processed.

Sensor output leads 4 of thermocouple sensors 2 are applied to computer system 6 in order to apply to computer system 6 electrical signals representative of the temperatures of heat flux detection containers 1a,b. Monitor screen 7 of computer system 6 displays a graphical representation of heat flux detection container 8 having the same aspect ratio as heat flux detection containers 1a,b and further containers 11. Using the signals from thermocouple sensors 3, applied by way of sensor output leads 4, computer system 6 displays material level 13 within the representation of heat flux detection container 8 while the process being monitored by heat flux detection system 10 is underway.

Material level 13, displayed within the graphical representation of container 8 on monitor screen 7 of computer system 6, is representative of the monitored parameter of the sample of material 5 within sample heat flux detection container 1a. Material level 13 on monitor screen 7 of computer system 6 is thus also representative of the monitored parameter of material 5 within further containers 11. Material level 13 may represent, for example, the percent of drying of material 5 in further containers 11 or the rate of drying of material 5 within further containers 11 during a drying process. Thus, using the method of the present invention, a selected process parameter, such as the rate of drying, can be determined, monitored, and displayed while single thermal energy control means 9 or single heating shelf 9 is still driving the process forward and applying thermal energy to heat flux detection containers 1a,b or absorbing thermal energy from heat flux detection containers 1a,b.

Drying chamber 12 of heat flux detection system 10 may be a conventional drying chamber. It will be understood by those skilled in the art that drying chamber 12 may be evacuated before processing or during processing. Additionally, drying chamber 12 may be operated without evacuation. Thus, it will be understood that the method of the present invention, using heat flux detection system 10, may also be practiced using such a conventional drying chamber 12 either with evacuation of drying chamber 12 or without evacuation of drying chamber 12.

Additionally, it will be understood that the method of the present invention may be practiced without the use of drying chamber 12. In the alternate embodiment, wherein the method of the present invention is practiced without drying chamber 12, heat flux detection containers 1a,b are placed on single heating surface 9 without disposing single heating surface 9, heat flux detection containers 1a,b, or further containers 11 within drying chamber 12. In this embodiment, thermal energy is then applied to heat flux detection containers 1a,b and further containers 11 containing material 5 by single thermal energy control device 9 and output signals are provided to computer system 6 by thermocouple sensors 2 by way of sensor output leads 4 as previously described.

Additionally, the method of the present invention may be practiced without heating surface 9. In such a system (not shown), the thermal energy of heat flux detection containers 1a,b and further containers 5 may be controlled by a radiant energy control device or some other type of thermal energy control device not requiring physical contact with containers 1a,b,11.

In the case of a freeze-drying process, the inner surfaces of drying chamber 12 are cooled and material 5 is frozen, forming ice within heat flux detection container 1a and further containers 11 containing material 5 being processed. The cooling of material 5 within drying chamber 12 may be performed by conventional refrigeration techniques or other known cooling methods. When the pressure in drying chamber 12 is reduced and the temperature of single heating surface 9 increased, the rate of sublimation of the ice of material 5 is determined within heat flux detection system 10 according to the difference in temperature between heat flux detection container la when there is no drying and heat flux detection container 1a when there is drying. This determination is thus made upon the same container when it is empty and when it is not empty.

It will be understood by those skilled in the art that heat flux detection containers 1a,b and further containers 11 may be any type of container suitable for holding material 5 during processing within heat flux detection system 10. If thermocouple type sensors 2 are used, heat flux detection containers 1a,b are adapted to permit thermocouple sensors 2 to be disposed upon them. Thus, further containers 11 holding material 5 being processed, which must be found the same as containers 1a,b, may also be any type of suitable container.

Improved performance of heat flux detection containers 1a,b within heat flux detection system 10 may be achieved by disposing or wrapping a reflective surface (not shown) or insulating material (not shown), such as aluminum foil, on or around heat flux detection container 1b or reference container 1b. This limits the amount of thermal energy transmitted through the outside walls of heat flux detection container 1b. When thermal energy transmission through the outside walls is limited, the temperature of heat flux detection container 1b is influenced less by any radiation of nearby heat flux detection container 1a or further containers 11. This prevents heat flux detection container 1b or reference container 1b from losing a significant amount of energy to sample container 1a or further containers 11 and causes reference container 1b to behave like an empty container.

The heat flux q(o) to unfilled heat flux detection container 1b or reference container 1b within heat flux detection system 10 is defined as:

$$q(o)=q(1)-q(r,1) \tag{1}$$

where q(1) is the heat flux to heat flux detection container 1b from single heating surface 9, and −q(r,1) is the heat loss by heat flux detection container 1b or detector vial 1b through radiation emission.

The heat flux q to heat flux detection container 1a or sample container 1a, containing material 5 to be monitored by heat flux detection system 10 during a process such as a drying process, is defined as:

$$q=q(2)+q(r,2) \tag{2}$$

where q(2) is the heat flux to heat flux detection container 1a containing material 5 and q(r,2) is the additional heat flux to heat flux detection 1a by radiation absorption through the outer walls of detection container 1a.

The heat flux q(1) to reference heat flux detection container 1b is given as:

$$q(1)=\frac{AK(T(s)-T(v,1))}{d} \tag{3}$$

where:

- A is the cross-sectional area of reference heat flux detection container 1b,
- K is the thermal conductivity between heat flux detection containers 1a,b and single heating surface 9,
- T(s) is the temperature of single heating surface 9 supporting heat flux detection containers 1a,b,
- T(v,1) is the temperature indicated by thermocouple sensor 2 disposed upon reference heat flux detection container 1b corrected for the temperature of heat flux detection container 1a, and
- d is the distance between single heating surface 9 and thermocouple sensor 2 of reference heat flux detection container 1b.

The heat flux q(2) to sample heat flux detection container 1a is defined as:

$$q(2)=\frac{AK(T(s)-T(v,2))}{d} \tag{4}$$

where T(v,2) is the temperature indicated by thermocouple sensor 2 of sample heat flux detection container 1a containing material 5 within heat flux detection system 10.

The heat flux to sample container 1a containing material 5 that is associated with the drying process being monitored by heat flux detection system 10 is represented by the difference in the heat flux (D(q)) between heat flux detection containers 1a,b. This difference in determined heat flux values D(q) is expressed as:

$$D(q)=q-q(o) \tag{5}$$

where q(o) is the heat flux to heat flux detection container 1a in the absence of drying, or $$D(q)=\frac{AK[(T(v,1)-T(v,2)]}{d}+q(r,2)+q(r,1). \tag{6}$$

where q(v,2) and q(v,1) are the heat flux to the outer walls of heat flux detection containers 1a,b, respectively. Setting AK/d =C, expression (6) becomes $$D(q)=C[(T(v,1)-T(v,2)]. \tag{7}$$

The rate of drying within heat flux detection system 10 is defined as:

$$R=\frac{q}{\Delta H_{v,T}}=\frac{D(q)}{\Delta H_{v,T}} \tag{8}$$

where $\Delta H_{v,T}$ is the heat of vaporization at a temperature (T) of heating surface 9. The substitution of the expression for D(q) in Equation (6) into Equation (8) yields:

$$R=\frac{C[(T(v,1)-T(v,2)]}{\Delta H_{v,T}}+\frac{q(r,2)+q(r,1)}{\Delta H_{v,T}}. \tag{9}$$

As q(r,2) and q(r,1) can be determined or as they approach a value of zero, then:

$$R=\frac{C[(T(v,1)-T(v,2)]}{\Delta H_{v,T}}. \tag{10}$$

Therefore, the drying rate of material 5, as determined by heat flux detection system 10, approaches zero as the value of T(v,1) approaches the value of T(v,2).

Thus, it will be understood by those skilled in the art that the method of the present invention, as practiced using heat flux detection system 10, determines the heat flux to or from heat flux detection containers 1a,b. Using these determinations, a further determination is made of the differential heat flux between heat flux detection containers 1a,b. From these determinations, many additional parameters may be determined. These additional parameters may include, but are not limited to, the rate of drying of material 5.

For example, the freezing rate of material 5 may be determined using heat flux detection system 10. Additionally, after the drying of material 5, a determination may be made of the stability of dried material 5. This stability determination may be made within heat flux detection system 10 by applying further thermal energy to heat flux detection containers 1a,b and further containers 11 by way of single heating shelf 9 within drying chamber 12 to cause dried material 5 to degrade. This degrading of material 5 may be measured to determine the stability of material 5. Additionally, this determination of the stability of material 5 may be made while single heating surface 9 and containers 1a,b,11 are outside drying chamber 12.

Heat flux detection system 10 of the present invention provides information on the heat flux to material 5 being processed during the time that processing of material 5 is taking place. Heat flux detection system 10 therefore can adjust process parameters during the processing of material 5 in accordance with heat flux related parameters which may be measured or determined within heat flux detection system 10 during the heating process. For example, the rate of drying may be determined by heat flux detection system 10 thereby permitting computer system 6 of heat flux detection system 10 to control thermal energy control means 9 by way of control line 14 to maintain the determined rate of drying or to alter the rate of drying. Additionally, computer system 6 may apply signals to drying chamber 12 by way of control line 14 to control the pressure within drying chamber 12, the processing time of material 5 within heat flux detection system 10, or any other process variable within drying chamber 12 and heat flux detection system 10.

The differential nature of the temperature measurements performed by heat flux detection system 10 of the present invention causes the determination of process parameters such as the drying rate of material 5 to be independent of thermocouple sensors 2 used in the process being monitored. In this way, a difference or change in the output of thermocouple sensors 2 does not have an effect on the determination of a process parameter by heat flux detection system 10. Furthermore, it will be understood by those skilled in the art that other types of sensors 2 besides thermocouples may be used to monitor heat flux detection containers 1*a,b* of heat flux detection system 10. The requirement for operation of heat flux detection system 10 is that sensors 2 produce a signal representative of the temperature of heat flux detection containers 1*a,b*.

Additionally, other methods for determining the temperature of heat flux detection containers 1*a,b*, not requiring physical contact between the sensors and heat flux detection containers 1*a,b*, may be used within heat flux detection system 10 of the present invention. For example, the temperature and heat flux of heat flux detection containers 1*a,b* may be determined by measuring radiant thermal energy in the vicinity of heat flux detection containers 1*a,b* by non-contact radiant energy sensors 2 or non-contact radiant temperature sensors 2. Such non-contact radiant energy sensors 2 or non-contact temperature sensors 2 may be used whether the method of the present invention is performed within drying chamber 12 or outside of drying chamber 12. In this respect, the only requirement for operation of heat flux detection system 10 is that sensors 2 provide computer system 6 with signals representative of the temperature of heat flux detection containers 1*a,b* in the same manner as that described for contact type thermocouple sensors 2 and suitable for the determination of the heat flux of heat flux detection containers 1*a,b*.

Drying chamber 12 may be provided with several shelves for supporting a larger number of further containers 11 of material 5 for processing during a process, such as a drying process, being monitored by heat flux detection system 10. Since it is possible for material 5 within further containers 11 on different shelves of multishelf drying chamber 12 to dry at different rates, each shelf of multishelf drying chamber 12 may be provided with an independent heat flux detection system 10. Each independent heat flux detection system 10 includes an individual sample container 1*a* and reference container 1*b*. This use of independent heat flux detection systems 10 permits independent determinations of the drying rates on each of the shelves of multishelf drying chamber 12. Additionally, a plurality of heat flux detection systems 10 may be provided on a single shelf of drying chamber 12 to permit independent determinations of the drying rate to be made at different areas on the same shelf.

Calibration of heat flux detection system 10 requires two steps. The first step in calibrating heat flux detection system 10 is determining the temperature of reference heat flux detection container 1*b* with respect to sample heat flux detection container 1*a* when heat flux detection containers 1*a,b* are both empty. Under these conditions, the temperature (T(v,1)) represents the temperature of heat flux detection container 1*a* when empty before the sample of material 5 is placed in heat flux detection container 1*a*.

The second part of the calibration procedure of heat flux detection system 10 requires the determination of the value C with respect to heat flux detection container 1*a*. This is accomplished by adding a known mass of water to heat flux detection container 1*a*. The quantity of water added to should be sufficient to just cover thermocouple temperature sensor 2 at the bottom of heat flux detection container 1*a*. Both heat flux detection containers 1*a,b* are sealed and refrigerated to cool containers 1*a,b* to a low temperature, for example, approximately five degrees C.

After approximately two hours at this temperature, heat flux detection containers 1*a,b* are removed from refrigeration and placed on a metal surface in an isothermal chamber that is at a temperature between twenty degrees C and thirty degrees C. From a knowledge of the temperature relationship between heat flux detection containers 1*a,b* and the heat capacity of water for a given temperature, the constant C for heat flux detection container 1*a* is determined by a measure of change in enthalpy per unit time as a function of $(T(v,1)-T(v,2))$. This relationship between the difference in heat flux between heat flux detection containers 1*a,b*, expressed as (D(q)), the temperature difference of heat flux detection containers 1*a, b*, $(T(v,1)-T(v,2))$, and the constant, $C=AK/d$, of a container is set forth in Equation (7).

With a knowledge of the value of C, as well as the amount of water in material 5, heat flux detection system 10 of the present invention indicates the rate at which the sample of material 5 is drying from heat flux detection container 1*a*. Heat flux detection system 10 thus permits computer system 6 to graphically display the fraction of material 5 that is dried on monitor screen 7. From the rate of drying, it is also possible for computer system 6 of heat flux detection system 10 to compute the completion time for a particular drying phase or for the total drying process.

While this invention has been described with reference to specific, and particularly preferred embodiments thereof, it is not limited thereto and the appended claims are intended to be construed to encompass not only the specific forms and variants of the invention shown but to such other forms and variants as may be devised by those skilled in the art without departing from the true spirit and scope of this invention.

I claim:

1. A system for processing a material in a processing system having a plurality of processing parameters and first and second heat flux detection containers, comprising:

a sample of said material disposed within said first heat flux detection container;

thermal energy control means for controlling the level of thermal energy of said first and said second heat flux detection containers;

means for determining the rate of drying of said material;

means for adjusting at least one process parameter of said plurality of process parameters in accordance with said determined rate of drying while said thermal energy control means controls the level of thermal energy to said first and second heat flux detection containers.

2. The system for processing a material according to claim 1, wherein said thermal energy control means comprises single warming means for simultaneously applying thermal energy both to said first heat flux detection container and to said second heat flux detection container.

3. The system for processing a material according to claim 2, wherein said single thermal energy control means comprises a single heating surface for disposing both said first heat flux detection container and said second heat flux detection container on said single heating surface.

4. The system for processing a material according to claim 1, wherein said means for determining said rate of drying said material further comprises:

means for determining said heat flux of said first and second heat flux detection containers; and, means for determining said rate of drying of said material in accordance with said determined heat flux.

5. The system for processing a material according to claim 1, wherein said thermal energy control means comprises a single cooling means for cooling both said first heat flux detection container and said second heat flux detection container.

6. The system for processing a material according to claim 1, wherein said thermal energy control means comprises a single refrigeration means for cooling both said first heat flux detection container and said second heat flux detection container.

7. The system for processing a material according to claim 1, wherein said second heat flux detection container is provided with insulating means for limiting radiant heat transfer through the outside walls of said second heat flux detection container.

8. The system for processing a material according to claim 7, wherein said insulating means is provided with a reflective surface.

9. The system for processing a material according to claim 7, wherein said insulating means is formed of metal foil.

10. The system for processing a material according to claim 4, wherein said heat flux determining means comprises means for determining a temperature difference between said first and second heat flux detection containers.

11. The system for processing a material according to claim 10, wherein said means for determining said temperature difference comprises means thermocouple sensor means disposed upon said first and second heat flux detection containers.

12. The system for processing a material according to claim 10, wherein said first and second heat flux detection containers have substantially similar thermal properties.

13. The system for processing a material according to claim 10, wherein said first and second heat flux detection containers are provided with respective container sensors.

14. The system for processing a material according to claim 13, wherein said respective container sensors are thermocouples for sensing the temperature of said first and second heat flux detection containers.

15. The system for processing a material according to claim 1, wherein said processing system is provided with at least one further heat flux detection container for applying said thermal energy control means to said further heat flux detection container.

16. The system for processing a material according to claim 15, wherein further material is disposed within said further heat flux detection container.

17. The system for processing a material according to claim 16, wherein said means for determining said rate of drying comprises means for determining said rate of drying of said further material within said further heat flux detection container in accordance with the determined heat flux of said first and second heat flux detection containers.

18. The system for processing a material according to claim 1, further comprising:

means for providing a plurality of values of said rate of drying of said material; and, display means for displaying said plurality of values.

19. The system for processing a material according to claim 1, wherein said means for adjusting said process parameter comprises means for adjusting said rate of drying of said material in accordance with said determined rate of drying of said material.

20. The system for processing a material according to claim 1, wherein said means for adjusting said process parameter comprises means for adjusting processing pressure in accordance with said determined rate of drying of said material.

21. The system for processing a material according to claim 1, wherein said means for adjusting said process parameter comprises means for adjusting process freezing rate in accordance with said determined rate of drying of said material.

22. The system for processing a material according to claim 1, wherein said means for adjusting comprises means for adjusting said thermal energy control means in accordance with said determined rate of drying of said material.

23. A method for determining a process parameter in a processing system having first and second heat flux detection containers, comprising the steps of:

(a) applying single energy control means both to said empty first heat flux detection container and to said second heat flux detection container;

(b) determining the temperatures of said empty first heat flux detection container and of said second heat flux container;

(c) disposing a known quantity of material within said empty first container;

(d) applying single energy control means both to said first heat flux detection container and to said second heat flux container;

(e) determining the temperature of said first and second heat flux detection containers; and, (f) determining the thermal constant of said first container in accordance with the determinations of steps (b) and (e).

* * * * *